United States Patent [19]

Felix

[11] 4,331,327

[45] May 25, 1982

[54] APPARATUS FOR DESTACKING AT LEAST TWO STACKS OF FLEXIBLE FLAT STRUCTURES, ESPECIALLY SHEETS OR PRINTED PRODUCTS

[75] Inventor: Willy Felix, Strengelbach, Switzerland

[73] Assignee: Jos. Hunkeler AG, Fabrik Fuer Graphische Maschinen, Wikon, Switzerland

[21] Appl. No.: 131,439

[22] Filed: Mar. 18, 1980

[30] Foreign Application Priority Data

Mar. 30, 1979 [CH] Switzerland ..... 2965/79

[51] Int. Cl.[3] ..... B65H 3/44; B65H 39/043

[52] U.S. Cl. ..... 271/9; 270/58; 271/12; 271/165

[58] Field of Search ..... 271/9, 99, 100, 101, 271/102, 190, 12, 95, 165, 166, 35; 270/58; 414/130, 128, 126, 125, 112, 77

[56] References Cited

U.S. PATENT DOCUMENTS 3,127,167 3/1964 Rabinow et al. ..... 271/95
3,926,427 12/1975 Moksnes et al. ..... 271/99 X
4,127,262 11/1978 Eberle et al. ..... 271/102 X

FOREIGN PATENT DOCUMENTS 516274 1/1931 Fed. Rep. of Germany ..... 271/12

*Primary Examiner*—Bruce H. Stoner, Jr.
*Attorney, Agent, or Firm*—Werner W. Kleeman

[57] ABSTRACT

Different stacks repose upon the lower section or run of an endless, revolvingly driven roller grate or grid arrangement. The return section or return run of the roller grate arrangement extends above or in overlying relation to the stacks. Below the stacks there travels a conveyor belt or band, whose conveying direction is opposite to the direction of movement of the roller grate arrangement. The rolls of the roller grate arrangement are obliquely positioned with respect to its direction of movement. Each stack possesses, at the region of the stack corner directed towards the oncoming or moving rolls, a separation element which draws the corner of the momentarily lowermost product between two rolls or rollers. By means of the subsequent rolls which travel between the lowermost product and the stack this lowermost product is separated from the stack and falls onto the conveyor belt or, as the case may be, onto products already reposing upon such conveyor belt. During the bringing together or collating of the individual products of the different stacks, each separated product is deposited in each instance upon the products or products which have already been separated from the preceding stack or stacks, respectively. The outfed collated or combined stack is therefore constituted by a respective product which has been withdrawn from each of the stacks.

5 Claims, 3 Drawing Figures

APPARATUS FOR DESTACKING AT LEAST TWO STACKS OF FLEXIBLE FLAT STRUCTURES, ESPECIALLY SHEETS OR PRINTED PRODUCTS

BACKGROUND OF THE INVENTION

The present invention relates to a new and improved construction of apparatus for destacking at least two stacks composed of flexible flat structures, especially sheets or printed products.

Generally speaking, the destacking apparatus for flexible flat structures of the invention is manifested by the features that a revolvingly driven roll grate arrangement forms the stack support surface of all stacks. The roll grate arrangement or roll grate moves along the base surface of the tandemly arranged stacks, and the grate rolls and the stacks are obliquely or inclinedly positioned relative to one another. Each stack has operatively associated therewith a driven separation device which is arranged below the stack support. Each separation device or separator serves to engage and downwardly pull the edge of the related lowermost flat surface structure periodically between the grate rolls. Also, there is provided a conveyor device arranged below the stacks serving to outfeed the flat structures which have been separated from the stacks.

One such type of apparatus is disclosed for instance in U.S. Pat. No. 4,127,262, granted Nov. 28, 1978 and the corresponding Swiss Pat. No. 598,106, wherein the rolls of the roll grate or grid arrangement extend at right angles to its direction of movement and the stacks are obliquely positioned with a corner directed towards such direction of movement. Below each stack there is arranged a conveyor band or belt for outfeeding the products which have been separated from the related stack. The conveyor belts are likewise obliquely positioned in accordance with the oblique or inclined positioning of the stacks, and thus, together with the direction of movement of the roll grate arrangement enclose an angle which results in a correspondingly wide construction of such equipment. Additionally, the products of the different stacks cannot be deposited upon the same conveyor belt, and, particularly, cannot be collected together.

SUMMARY OF THE INVENTION

Therefore, with the foregoing in mind it is a primary object of the present invention to provide a new and improved construction of a destacking apparatus for various types of products, especially flexible flat structures, which is not afflicted with the aforementioned drawbacks or limitations of the prior art construction discussed above.

Another and more specific object of the present invention is to overcome the previously mentioned disadvantages and to provide a destacking apparatus of the character described which, with very little expenditure in equipment, allows for a faultless outfeed and, particularly, assembling or grouping together of the individual flat structures which have been separated from the different stacks.

Yet a further significant object of the present invention aims at the provision of a new and improved construction of apparatus for destacking flexible flat structures which is simple in design, economical to manufacture, possesses a compact construction, is not readily subject to breakdown or malfunction and requires a minimum of maintenance and servicing.

Now in order to implement these and still further objects of the invention, which will become more readily apparent as the description proceeds, the destacking apparatus of the present development is manifested by the features that the roll grate arrangement is structured so that it is returned back above the stacks and the conveyor device comprises a conveyor element which is common to all of the stacks, and the conveying direction of the conveyor element is opposite to the direction of movement of the roll grate arrangement.

The return of the roll or roller grate arrangement above the stacks now makes it possible to arrange below the latter a conveyor element, for instance a conveyor belt or band, serving for the outfeed of the separated products which have been destacked from all of the stacks. This also enables collecting or grouping together the separated products. Since the conveyor element travels in the direction of movement of the roll grate arrangement there is possible a construction which, in its width, is extremely space-saving.

According to a preferred manifestation of the invention the rolls of the roll grate arrangement or roll grate are obliquely or inclinedly positioned with respect to its direction of movement and the stack is aligned with respect to this direction of movement. Since the stacks extend with their side edges essentially parallel to the conveying direction of the conveyor element, it is possible to deposit the flat structures, for the subsequent further processing, in a proper position onto the conveyor element.

BRIEF DESCRIPTION OF THE DRAWINGS

The invention will be better understood and objects other than those set forth above will become apparent when consideration is given to the following detailed description thereof. Such description makes reference to the annexed drawings, wherein throughout the various embodiments the same reference characters have been generally used to denote the same or analogous elements and wherein:

FIG. 3 is a sectional view, like the showing of FIG. 2, but of a modified arrangement.

DETAILED DESCRIPTION OF THE PREFERRED EMBODIMENTS

Figure 1:
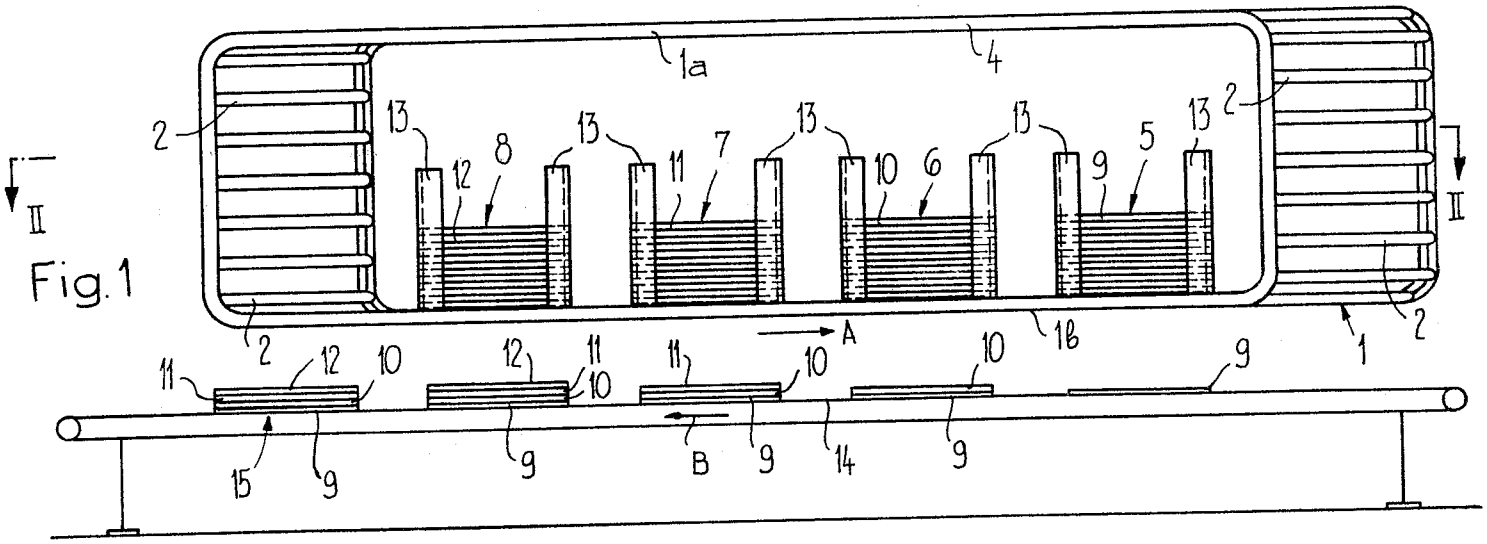
FIG. 1 is a side schematic view of apparatus for bringing or grouping together the destacked flat structures or products constructed according to the invention.

Describing now the drawings, the apparatus illustrated in FIG. 1 which serves to group or bring together the destacked flat structures will be seen to comprise an endless roll grate arrangement or roll grate 1 which is revolvingly driven in any suitable manner in the direction of the arrow A. The invention is not concerned with any specific drive means for driving the roll grate arrangement 1 and conventional drives can be used for this purpose. The rolls or rollers 2 of such roll grate arrangement 1 extend essentially parallel to one another and at a mutual spacing from one another. These rolls or rollers 2 engage at their opposed ends into the guide rails or tracks 3 and 4, where there is guided a respective not particularly illustrated, conventional chain with which there is connected the one end of the rolls 2. These rolls 2 are obliquely or inclinedly positioned in relation to the direction of movement A of the roll grate arrangement 1 and enclose with respect to its direction of movement A an angle of, for instance, 60°. The guide rails 3 and 4 are mutually offset, in accordance with this oblique positioning of the rolls 2, in the direction of movement A, as particularly well seen by referring to FIG. 2. Internally of the roll grate arrangement 1 there are arranged behind one another, i.e. in tandem, viewed with respect to its direction of movement A, a number of stack 5, 6, 7 and 8 containing the flat structures which are to be destacked. Each of these stacks 5, 6, 7 and 8, formed by flexible flat structures 9, 10, 11 and 12, respectively, for instance folded or unfolded sheets or printed products, is located in a stack chute, each such stack chute being defined by four respective contact rails 13 or equivalent structure. The lower section or run 1*b* of the roll grate or grate arrangement 1 forms the support means for the stacks 5, 6, 7 and 8. At this section or run 1*b* of the roll grate 1 the latter moves along the base surface of the stacks 5, 6, 7 and 8. The return or return run 1*a* of the roll grate arrangement 1 extends above the stacks 5, 6, 7 and 8, as clearly seen by referring to FIG. 1. The stacks 5, 6, 7 and 8 are aligned with respect to the direction of movement A, that is to say, and as particularly well seen by referring to FIG. 2, the longitudinal sides of the stacks 5, 6, 7 and 8 extend parallel to the direction of movement A. Below the stacks 5, 6, 7 and 8 there is arranged a conveyor element, here shown in the form of a conveyor belt or band 14, whose direction of movement or conveying direction B is directed opposite to the direction of movement A of the roll grate arrangement 1.

For destacking the lowermost product of each stack 5, 6, 7 and 8 there is operatively associated with each stack a separation device which has not been particularly shown in the drawings to simplify the illustration, particularly since details of such separation device do not constitute part of the present development. Each such separation device comprises a separation element provided with a suction head which is arranged at the region of the stack corner directed towards the oncoming rolls 2, i.e. at the region of the left upper corner shown in FIG. 2. As mentioned, the construction and mode of operation of such separation devices are well known in the art, as exemplified by for instance the aforementioned U.S. Pat. No. 4,127,262, to which reference may be readily had and the disclosure of which is incorporated herein by reference. Each such separator element is periodically upwardly moved through the intermediate space between two rolls 2 and by means of its suction head seizes the corner of the lowermost product 9, 10, 11 or 12, as the case may be. Thereafter the separation element again moves downwardly and draws this seized produce corner through and between the two rolls 2. This now enables the trailing roller or roll to move between this lowermost product and the stack, and in conjunction with the trailing or following roll this lowermost product is effectively separated or destacked from the stack. Here also, reference may be made to the aforementioned U.S. Pat. No. 4,127,262 describing in detail such separation operation. The products 9, 10, 11 and 12 which are separated in this manner are then outfed by the conveyor belt or band 14.

The separation of the products from the individual stacks is controlled as a function of the conveying speed of the conveyor belt 14 such that there is accomplished a grouping together of the products of the different stacks, as the same has been shown in FIG. 1. Thus, each product 10, 11 or 12 which has been destacked from the stacks 6, 7 and 8, respectively, is deposited onto the products which have been separated from the preceding stack or stacks. Each product stack 15 which departs from the apparatus for grouping together or collating the products, as best seen by referring to FIG. 1, is formed by a product 9 from the stack 5, a product 10 from the stack 6, a product 11 from the stack 7 and a product 12 from the stack 8. Since, as mentioned, the stacks 5, 6, 7 and 8 are aligned with the direction of movement A, and thus, also with the direction of conveying B, the collated or grouped together stack 15 assumes a position which is proper for further processing.

It should be understood that the described apparatus not only can be used for grouping together or collating flat structures or the like. Thus, for instance, it is possible to alternately destack one of the stacks during a given time span. The products which are separated from such stack are then individually outfed by the conveyor belt or band 14.

Figure 2:
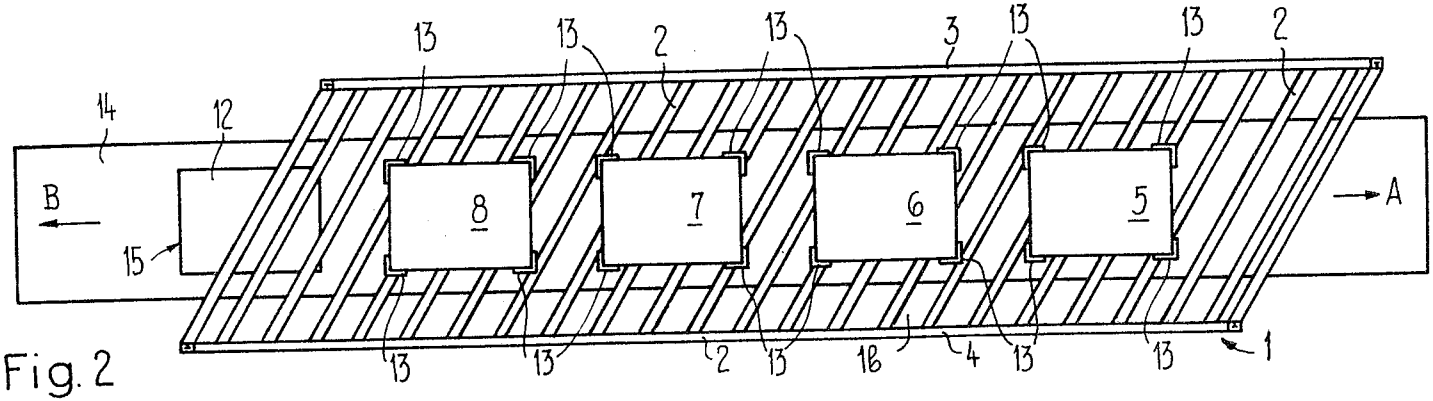
FIG. 2 is a sectional view of the arrangement of FIG. 1, taken substantially along the line II—II thereof.

It is also possible to arrange the rolls 2 of the roll grate or grid arrangement 1 and the stacks 5, 6, 7 and 8 in the manner as disclosed in the aforementioned U.S. Pat. No. 4,127,262. With this embodiment and as best seen from the showing of FIG. 3, the rolls 2 extend at right angles to the direction of movement A, whereas the stacks 5, 6, 7 and 8 are obliquely positioned with respect to such direction of movement A, so that each stack extends with one of its corners towards the direction of movement A. At the region of the stack corner there is arranged the related separation element which, in the described manner, downwardly pulls the corner of the momentarily lowermost product of the stack between two rolls 2 of the roll grate arrangement 1. With this modified version of the equipment as shown in FIG. 3 the products which bear upon the conveyor belt 14, in contrast to the embodiment illustrated in FIGS. 1 and 2, are obliquely or inclinedly positioned with respect to the direction of conveying B of the conveyor belt 14. One corner of the outfed composite stack 15 therefore travels in a leading position, which, under circumstances, can render more difficult further processing of the stacked products.

It is also conceivable to provide, instead of the conveyor belt 14, a different suitable conveyor element. Equally, the separation device can be differently constructed than heretofore described.

While there are shown and described present preferred embodiments of the invention it is to be distinctly understood that the invention is not limited thereto, but may be otherwise variously embodied and practised within the scope of the following claims.

What I claim is:

1. In an apparatus for destacking at least two stacks of flexible flat structures, especially sheets or printed products, wherein a revolvingly driven roll grate arrangement forms the stack support surface for all of the stacks, the roll grate arrangement travelling in a predetermined direction of movement along a base surface of the stacks which are arranged in tandem with respect to one another, the roll grate arrangement containing grate rolls, said grate rolls and the stacks being obliquely positioned relative to one another, a respective driven separator device arranged below the roll grate arrangement constituting the stack support surface and operatively associated with a related one of the stacks, each of the separation devices serving to periodically engage between the grate rolls in order to seize and downwardly draw an edge of the momentarily engaged flat structure of the related stack, and a conveyor device arranged below the stacks for outfeeding the flat structures which have been separated from the stacks, the improvement which comprises:

said roll grate arrangement being arranged to have a returning portion extending above the stacks;

the conveyor device comprising a conveyor element which is common for all of the stacks; and said conveyor element having a direction of conveying which is opposite to the direction of movement of the roll grate arrangement.

2. The improvement as defined in claim 1, wherein:

said rolls of the roll grate arrangement are obliquely positioned with respect to the direction of movement of said roll grate arrangement; and said stacks are aligned with respect to said direction of movement.

3. The improvement as defined in claim 1, wherein:

the rolls of the roll grate arrangement extend essentially at right angles with respect to the direction of movement of the roll grate arrangement; and the stacks are inclinedly positioned such that one of their corners extends towards this direction of movement.

4. The improvement as defined in claim 1, wherein:

said apparatus is used for collating the flat structures which have been separated from the individual stacks.

5. An apparatus for grouping together the products separated from at least two stacks of flexible flat structures, especially sheets or printed products, comprising:

a revolvingly driven roll grate arrangement forming the stack support surface for all of the stacks;

said roll grate arrangement travelling in a predetermined direction of movement along a base surface of the stacks which are arranged in tandem with respect to one another;

said roll grate arrangement containing grate rolls;

said grate rolls and the stacks being obliquely positioned relative to one another;

a conveyor device arranged below the stacks for outfeeding the flat structures which have been separated from the stacks;

said roll grate arrangement being arranged to have a returning portion extending above the stacks;

said conveyor device comprising a conveyor element which is common for all of the stacks; and said conveyor element having a direction of conveying which is opposite to the direction of movement of the roll grate arrangement.

* * * * *